US009646775B2

(12) United States Patent
Law et al.

(10) Patent No.: US 9,646,775 B2
(45) Date of Patent: May 9, 2017

(54) TERMINAL BLOCKS INCLUDING INTEGRAL SAFETY RELAYS HAVING INDEPENDENTLY TESTABLE CONTACTS

(71) Applicant: Fisher-Rosemount Systems, Inc., Round Rock, TX (US)

(72) Inventors: Gary Keith Law, Georgetown, TX (US); Kent Allan Burr, Round Rock, TX (US)

(73) Assignee: Fisher-Rosemount Systems, Inc., Round Rock, TX (US)

( * ) Notice: Subject to any disclaimer, the term of this patent is extended or adjusted under 35 U.S.C. 154(b) by 664 days.

(21) Appl. No.: 14/045,884

(22) Filed: Oct. 4, 2013

(65) Prior Publication Data

US 2014/0097850 A1 Apr. 10, 2014

Related U.S. Application Data

(60) Provisional application No. 61/710,290, filed on Oct. 5, 2012.

(51) Int. Cl.

| | |
|---|---|
| ***H01H 1/00*** | (2006.01) |
| ***H01H 13/70*** | (2006.01) |
| ***H01H 9/10*** | (2006.01) |
| ***H01H 47/00*** | (2006.01) |

(52) U.S. Cl.

CPC ..... *H01H 1/0015* (2013.01); *H01H 9/10* (2013.01); *H01H 13/70* (2013.01); *H01H 47/002* (2013.01)

(58) Field of Classification Search

None

See application file for complete search history.

(56) References Cited

U.S. PATENT DOCUMENTS

| | | | | |
|---|---|---|---|---|
| 7,053,624 | B2 * | 5/2006 | Klijn | G01R 31/3278 324/415 |
| 7,180,297 | B2 * | 2/2007 | Deak | G01R 31/3278 324/418 |
| 2006/0006898 | A1 * | 1/2006 | Kusumoto | G01R 31/2853 324/750.3 |

(Continued)

OTHER PUBLICATIONS

Rockwell Automation, Allen-Bradley, "1771 Digital I/O Relay Contact Output Modules" (Published Sep. 1997).*

(Continued)

*Primary Examiner* — Melissa Koval
*Assistant Examiner* — Felicia Farrow
(74) *Attorney, Agent, or Firm* — Hanley, Flight & Zimmerman, LLC

(57) ABSTRACT

An example apparatus includes a terminal block couplable to an electronics cabinet or mounting rail. The terminal block defines a first receptacle to receive a first circuit and a second receptacle to receive a second circuit. The terminal block includes an integral relay. The integral relay includes a first contact and a second contact. The first and second contacts are externally accessible relative to the terminal block. The integral relay further includes a first switch and a second switch. The first and second switches are electrically coupled between the first and second contacts. The first and second switches are respectively movable between corresponding open and closed positions. The first and second switches are independently testable to verify the respective operability of the first switch and the second switch.

10 Claims, 6 Drawing Sheets

(56) References Cited

U.S. PATENT DOCUMENTS

| | | | | |
|---|---|---|---|---|
| 2006/0209488 | A1* | 9/2006 | Papenbreer | H01H 47/002 361/160 |
| 2008/0079318 | A1* | 4/2008 | Burr | H01H 47/005 307/115 |

OTHER PUBLICATIONS

Emerson Process Management, "DeltaV SIS Conditioning Components", Jul. 2009, 9 pages.
Emerson Process Management, "S-series Electronic Marshalling", Jun. 2012, 35 pages.

* cited by examiner

TERMINAL BLOCKS INCLUDING INTEGRAL SAFETY RELAYS HAVING INDEPENDENTLY TESTABLE CONTACTS

RELATED APPLICATION

This patent arises from and claims priority to U.S. Provisional Patent Application No. 61/710,290, filed Oct. 5, 2012, which is hereby incorporated herein by reference in its entirety.

FIELD OF THE DISCLOSURE

This disclosure relates generally to terminal blocks and, more particularly, to terminal blocks including integral safety relays having independently testable contacts.

DETAILED DESCRIPTION

Figure 1:
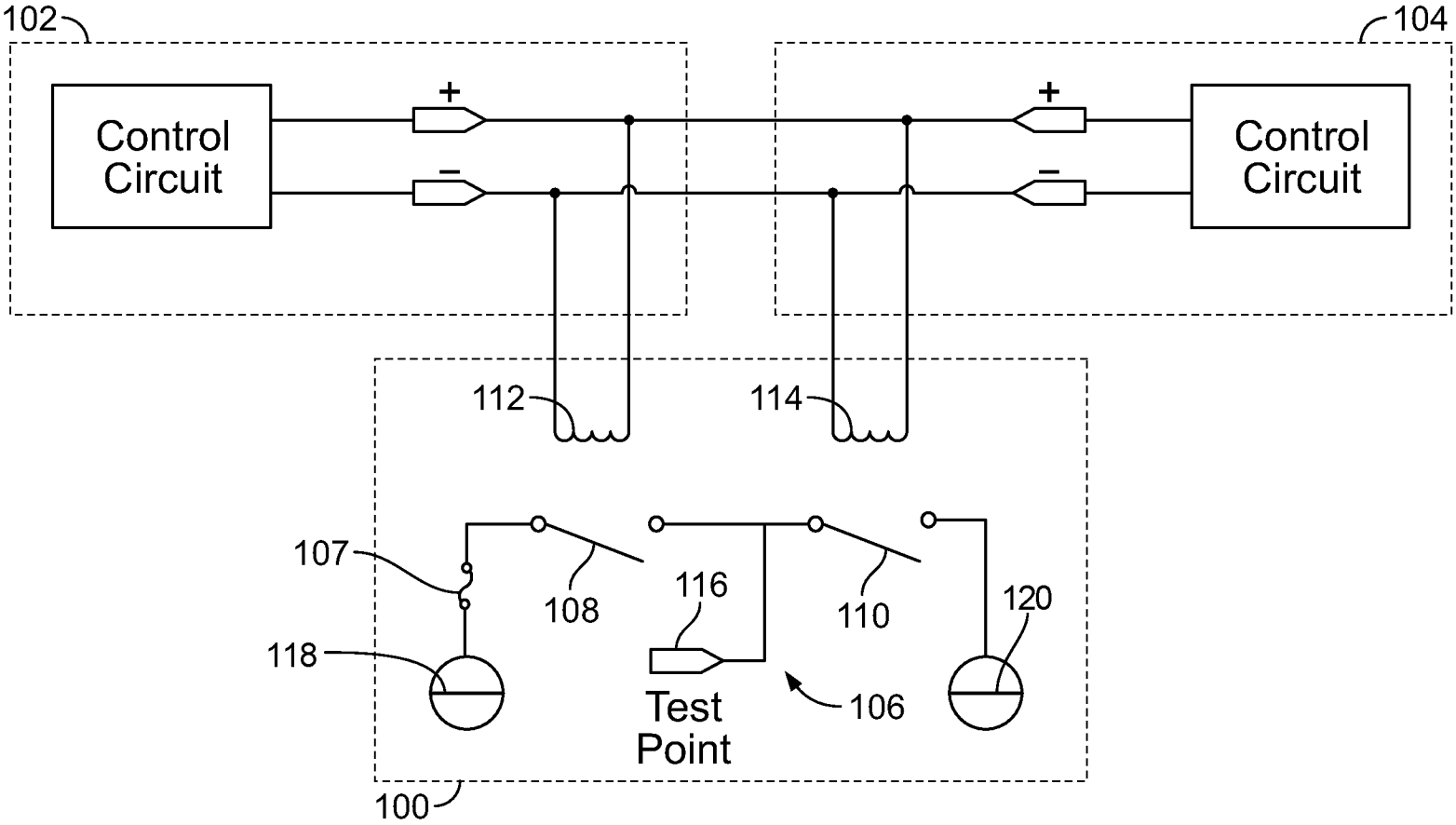
FIG. 1 depicts an example termination module and first and second control circuits in accordance with the teachings of this disclosure.

Certain examples are shown above in the identified figures and described below in detail. In describing these examples, like or identical reference numbers are used to identify the same or similar elements. The figures are not necessarily to scale. Certain features and views of the figures may be exaggerated in scale or may be in schematic form for clarity or conciseness. Additionally, several examples have been described throughout this specification. Any features from any example may replace, be included with, or otherwise combined with other features from other examples.

Some safety instrumented systems may include safety relays, which may require a relatively high degree of diagnostic coverage and fault tolerance. For example, a hardware device fault tolerance of one implies that one component of the device could fail and the function would still be performed by the device. From these requirements, safety relays have been developed that provide multiple switching elements to break an electrical path between, for example, a power source or other signal source and a field device. Generally, these safety relays use multiple force-guided relays that have mechanically linked relay contacts. As a result, the relay contacts move together when one or more relay coils are energized or de-energized.

In some examples, a de-energize-to-fail circuit may include two relay contacts electrically coupled in series. In such examples, either of the relays may break the electrical path to a field device (e.g., a field actuator) to remove its power. In other examples (energize to actuate), two relays have coils electrically coupled in parallel such that when power is removed, both relays close.

The examples disclosed herein relate to terminations, termination modules and/or blocks including integral relays having independently testable contacts. In some examples, the example termination blocks include integral relays associated with a de-energize-to-fail circuit. In some such examples, the coils are powered from the same source and the relay contacts are electrically coupled in series. To enable a user to test the operability of the relay contacts during a proof test, in some examples, the example termination block includes a test point. To perform a proof test, a user may measure the resistance across the contacts (e.g., the voltage should be zero) and then actuate the relays and measure the voltage between the test point and the first and/or second relay contacts to verify that the contacts associated with the coil are not welded or otherwise unable to break an electrical path.

In other examples, the example termination blocks include integral relays associated with an energize-to-actuate circuit. Is some such examples, the coils are individually actuated and the relay contacts are electrically positioned in parallel. To perform a proof test, a user may measure the voltage across the contacts (e.g., the voltage should be non-zero) and then actuate the relays and measure the voltage between the relay contacts (e.g., field termination points) in sequence to verify that the contact associated with the coil is not welded or otherwise unable to break an electrical path.

FIG. 1 depicts an example termination module 100 and first and second control circuits 102, 104 coupled thereto. The termination module 100 and/or the control circuits 102, 104 may be coupled between one or more field devices and one or more controllers. In some examples, the termination module 100 protects the control circuits 102, 104 from, for example, a power surge. In some examples, the control circuits 102, 104 are I/O cards (e.g., CHARM I/O Cards of Emerson Process Systems) that translate information received from the field devices to a format compatible with the controllers and translate information from the controllers to a format compatible with the field devices.

In this example, the termination module 100 includes an integral relay module 106 and a fuse 107. The relay module 106 includes first and second switches 108, 110 electrically coupled in series. In some examples, the switches 108 and 110 may respond to signals from coils and/or inductors 112, 114 to simultaneously open and/or close. In other examples, the switches 108 and 110 may not simultaneously open and, instead, may open and close independently.

The relay module 106 may be coupled to the control circuits 102, 104 to control the conveyance of power and/or other signals to the control circuits 102, 104. Thus, in operation, the relay module 106 may be used to apply power to the control circuits 102, 104, remove power from the control circuits 102, 104 and/or apply or remove any other signal(s) from the control circuits 102, 104.

To enable the relay module 106 to be proof tested to ensure that the switches 108, 110 are operational and not welded, for example, the example relay module 106 includes a test point and/or area 116. To perform the proof test, a user may measure the voltage between a first contact 118 and the test point 116 with the first switch 108 in the open and closed states and then measure the voltage between a second contact 120 and the test point 116 with the second switch 110 in the open and closed states. If the switches 108, 110 are operating properly, no voltage will be measured when the respective switches 108, 110 are closed and voltage will be measured when the respective switches 108, 110 are open.

Figure 2:
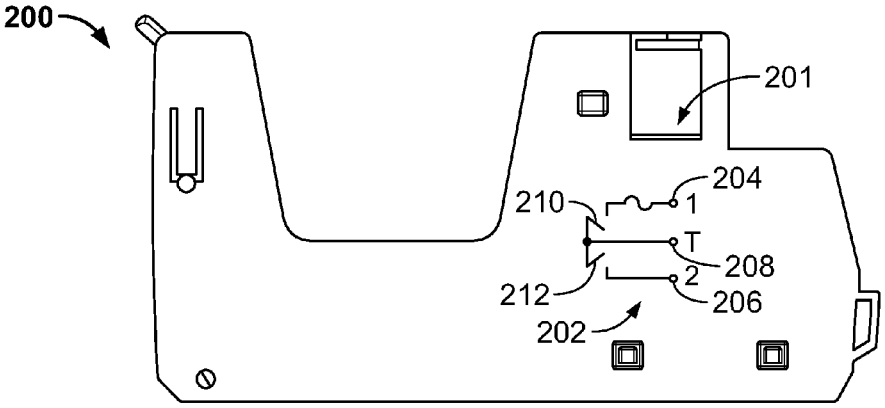
FIGS. 2-4 depict different views of an example termination module in accordance with the teachings of this disclosure.
Figure 3:
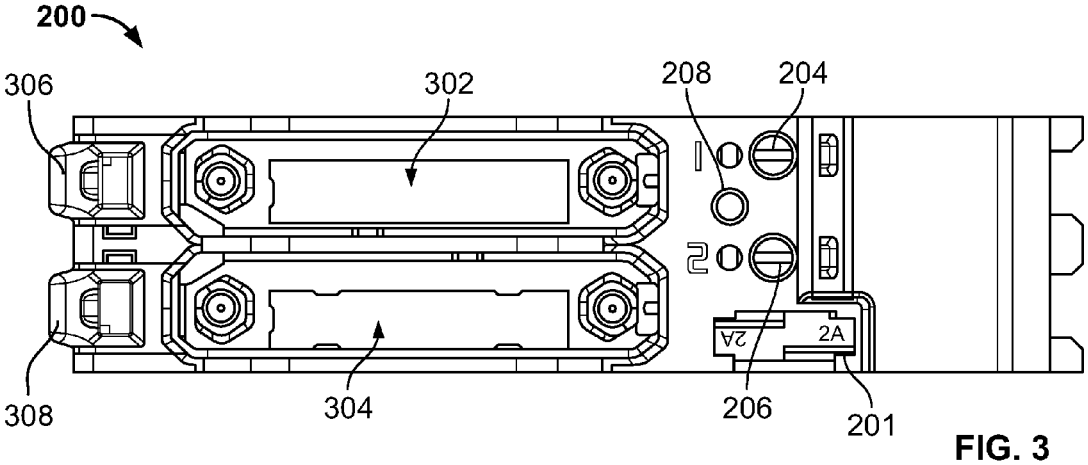
Figure 4:
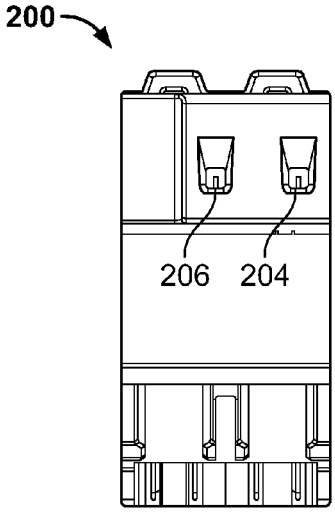

FIGS. 2-4 depict different views of an example termination module 200 that can be used to implement the examples disclosed herein. The termination module 200 includes a fuse receptacle and/or aperture 201 and an integral relay module 202 with testable contacts 204, 206, a test point 208 and switches 210, 212 in series. To enable the termination module 200 to be coupled to and/or receive the control circuits, the termination module 200 defines first and second receptacles 302, 304 (FIG. 3). The termination module 200 further includes first and second latches 306, 308. The first latch 306 is movable between a first position that enables a first control circuit to be secured within the first receptacle 302 and a second position that enables the first control circuit to be removed from the first receptacle 302. The second latch 308 is movable between a first position that enables a second control circuit to be secured within the second receptacle 304 and a second position that enables the second control circuit to be removed from the second receptacle 304.

Figure 5:
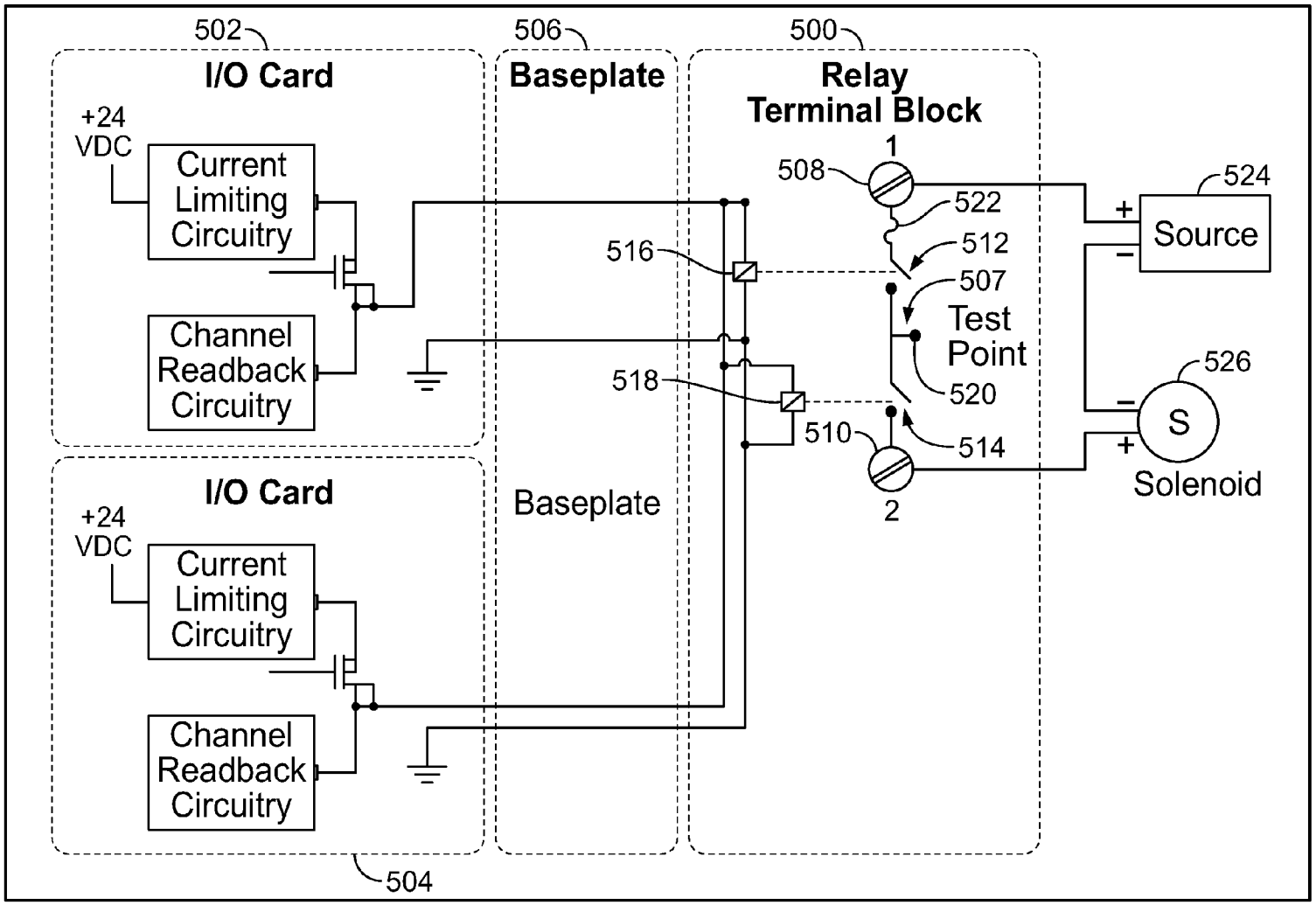
FIG. 5 depicts an example termination module and first and second I/O Cards in accordance with the teachings of this disclosure.

FIG. 5 depicts an example termination module 500 and first and second control circuits and/or I/O cards 502, 504 coupled thereto via a baseplate 506. The termination module 500 and/or the control circuits 502, 504 may be coupled between one or more field devices and one or more controllers. In some examples, the control circuits 502, 504 are I/O cards (e.g., CHARM I/O Cards of Emerson Process Systems) that translate information received from the field devices to a format compatible with the controllers and translate information from the controllers to a format compatible with the field devices. One or more of the control circuits 502, 504 may include current limiting circuitry and/or channel readback circuitry.

In this example, the termination module 500 includes an integral relay module 507 including first and second termination screws 508, 510, switches 512, 514, coils and/or inductors 516, 518, a test point 520 and a fuse 522. The relay module 507 may be coupled to the control circuits 502, 504 to control the conveyance of power from a power source 524 and/or other signals to the control circuits 502, 504 and/or a solenoid 526. Thus, in operation, the relay module 507 may be used to apply power to the control circuits 502, 504 and/or the solenoid 526, remove power from the control circuits 502, 504 and/or the solenoid 526 and/or apply or remove any other signal(s) from the control circuits 502, 504 and/or the solenoid 526. While FIG. 5 includes the solenoid 526, the solenoid may be any other device such as a relay, a motor, a horn, a buzzer, etc.

Figure 6:
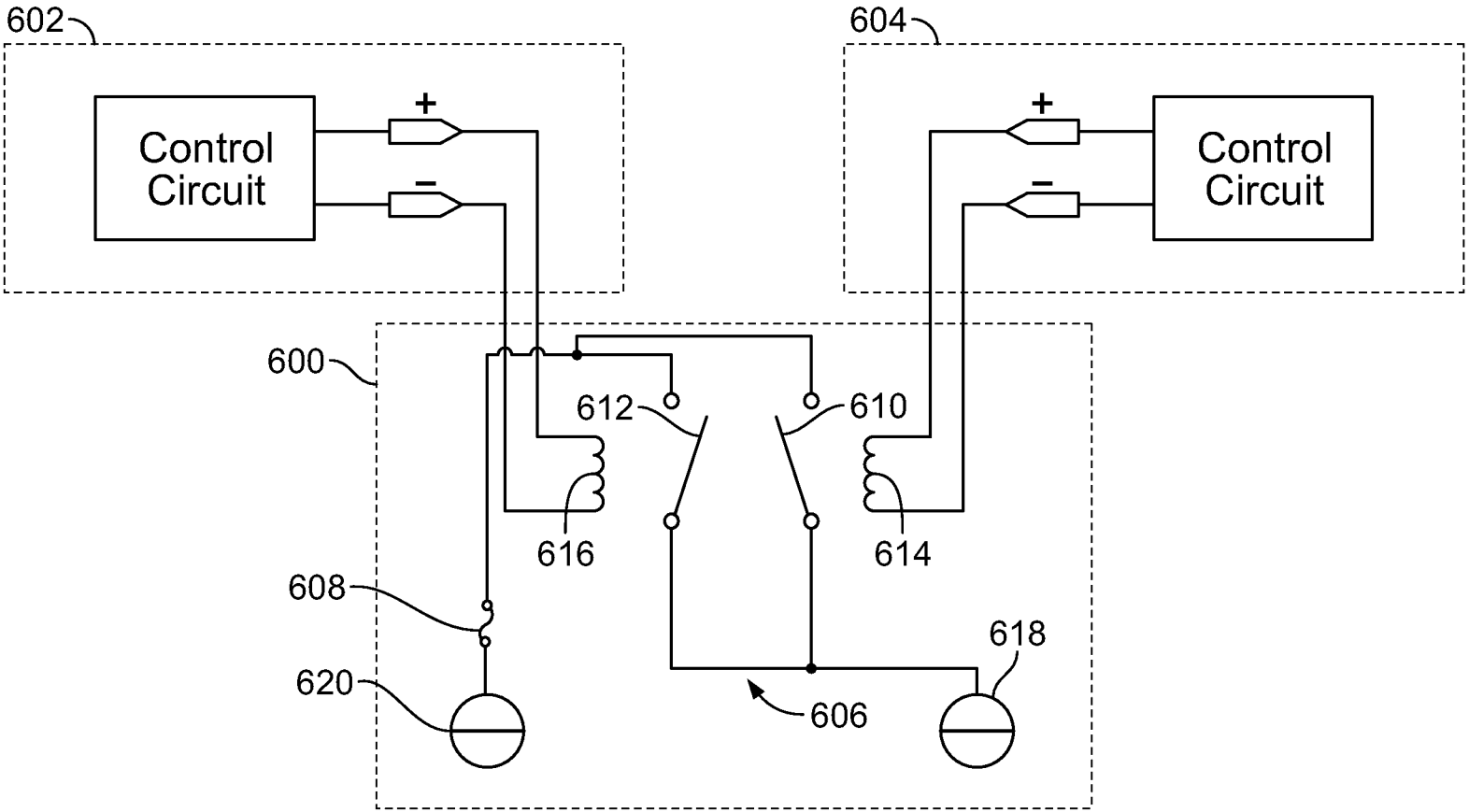
FIG. 6 depicts an example termination module and first and second control circuits in accordance with the teachings of this disclosure.

FIG. 6 depicts an example termination module 600 and first and second control circuits 602, 604 coupled thereto. The termination module 600 and/or the control circuits 602, 604 may be coupled between one or more field devices and one or more controllers. In some examples, the termination module 600 protects the control circuits 602, 604 from, for example, a power surge. In some examples, the control circuits 602, 604 may be I/O cards (e.g., CHARM I/O Cards of Emerson Process Systems) that translate information received from the field devices to a format compatible with the controllers and translate information from the controllers to a format compatible with the field devices.

In this example, the termination module 600 includes an integral relay module 606 and a fuse 608. The relay module 606 includes first and second switches 610, 612 electrically coupled in parallel that may respond to signals from coils 614, 616 to close. In some examples, the switches 610 and 612 may open and/or close independently at different times. However, in other examples, the switches 610 and 612 may open simultaneously.

The relay module 606 may be coupled to the control circuits 602, 604 to control the conveyance of power and/or other signals to the control circuits 602, 604. Thus, in operation, the relay module 606 may be used to apply power to the control circuits 602, 604, remove power from the control circuits 602, 604 and/or apply or remove any other signal(s) from the control circuits 602, 604.

To proof test the relay module 606 to ensure that the switches 610, 612 are operational and not welded, fused, or otherwise unable to break an electrical path, for example, a user may open both switches 610, 612 and measure the voltage between first and second contacts 618, 620. The voltage between first and second contacts 618, 620 is measured with the second switch 612 open and the first switch 610 closed. The voltage between first and second contacts 618, 620 is measured with the first switch 610 open and the second switch 612 closed. If the switches 610, 612 are operating properly, no voltage will be measured when one or both of the switches 610, 612 are closed and voltage will be measured when the switches 108, 110 are open.

Figure 7:
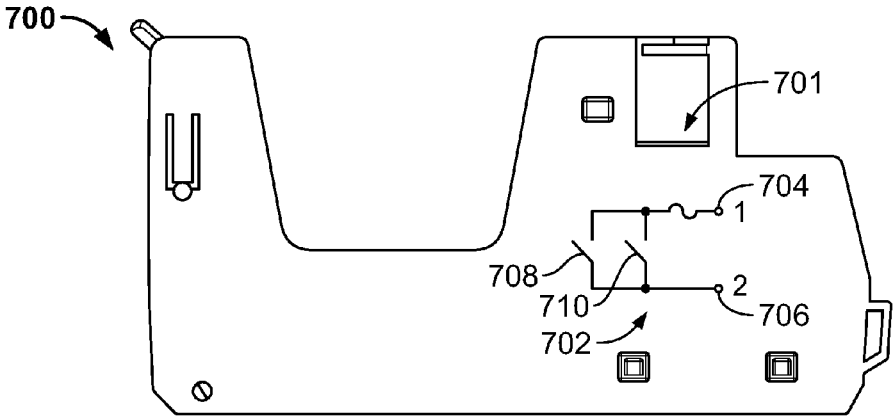
FIGS. 7-9 depict different views of an example termination module in accordance with the teachings of this disclosure.
Figure 8:
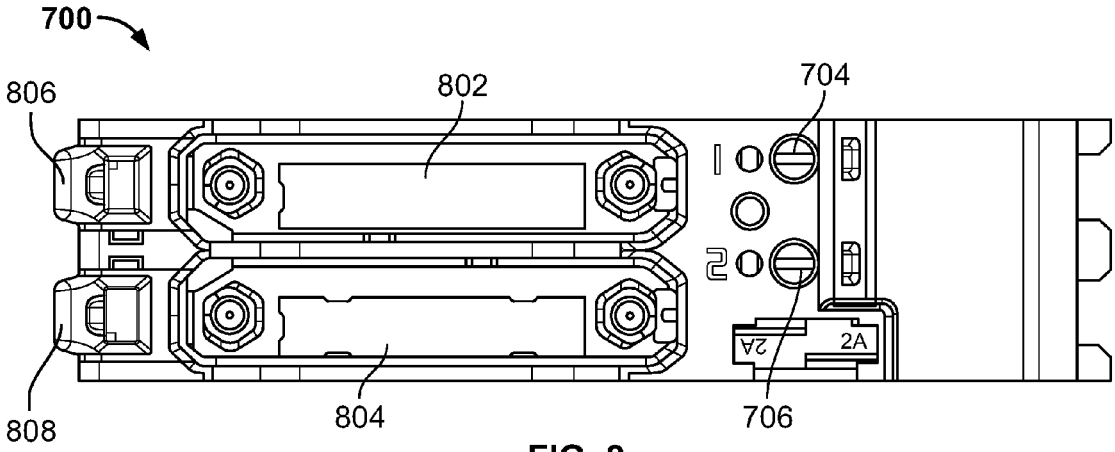
Figure 9:
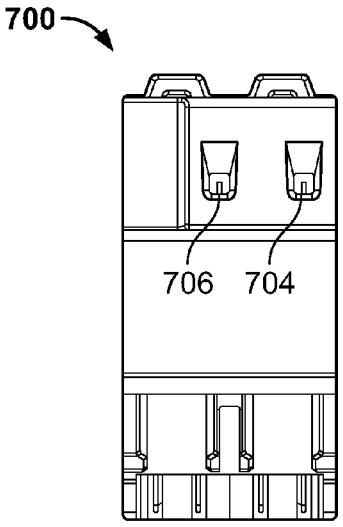

FIGS. 7-9 depict different views of an example termination module 700 that can be used to implement the examples disclosed herein. The termination module 700 includes a fuse receptacle and/or aperture 701 and an integral relay module 702 with testable contacts and/or termination screws 704, 706 and switches 708, 710 electrically coupled in parallel. To enable the termination module 700 to be coupled to and/or receive the control circuits, the termination module 700 defines first and second receptacles 802, 804. The termination module 700 further includes first and second latches 806, 808. The first latch 806 is movable between a first position that enables a first control circuit to be secured within the first receptacle 802 and a second position that enables the first control circuit to be removed from the first receptacle 802. The second latch 808 is movable between a first position that enables a second control circuit to be secured within the second receptacle 804 and a second position that enables the second control circuit to be removed from the second receptacle 804.

Figure 10:
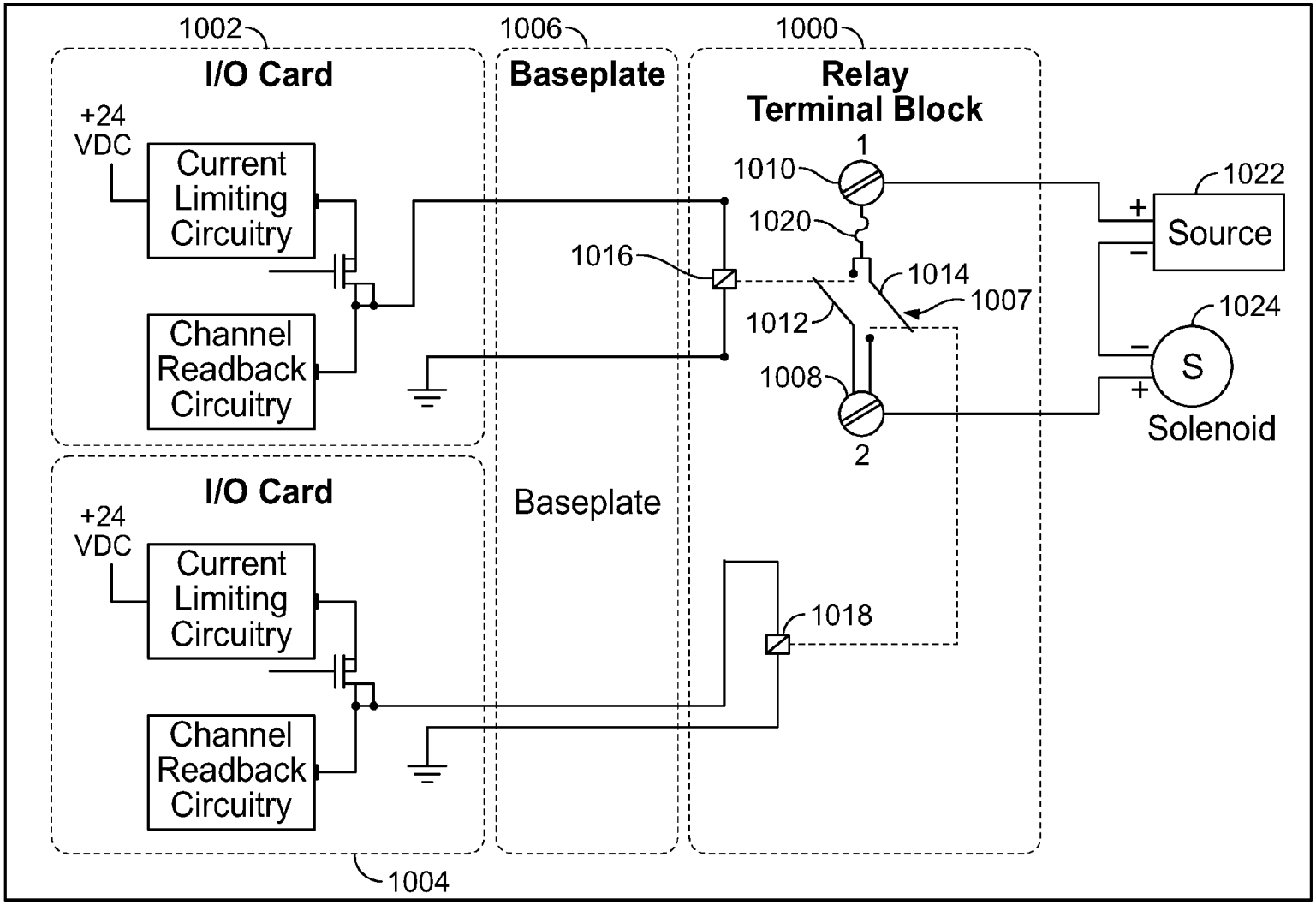
FIG. 10 depicts an example termination module and first and second I/O Cards in accordance with the teachings of this disclosure.

FIG. 10 depicts an example termination module 1000 and first and second control circuits and/or I/O cards 1002, 1004 coupled thereto via a baseplate 1006. The termination module 1000 and/or the control circuits 1002, 1004 may be coupled between one or more field devices and one or more controllers. In some examples, the control circuits 1002, 1004 may be I/O cards (e.g., CHARM I/O Cards of Emerson Process Systems) that translate information received from the field devices to a format compatible with the controllers and translate information from the controllers to a format compatible with the field devices. One or more of the control circuits 1002, 1004 may include current limiting circuitry and/or channel readback circuitry.

In this example, the termination module 1000 includes an integral relay module 1007 including first and second termination screws 1008, 1010, switches 1012, 1014, coils and/or inductors 1016, 1018 and a fuse 1020. The relay module 1007 may be coupled to the control circuits 1002, 1004 to control the conveyance of power from a power source 1022 and/or other signals to the control circuits 1002, 1004 and/or a solenoid 1024. Thus, in operation, the relay module 1007 may be used to apply power to the control circuits 1002, 1004 and/or the solenoid 1024, remove power from the control circuits 1002, 1004 and/or the solenoid 1024 and/or apply or remove any other signal(s) from the control circuits 1002, 1004 and/or the solenoid 1024. While FIG. 10 includes the solenoid 1024, the solenoid may be any other device such as a relay, a motor, a horn, a buzzer, etc.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus, comprising:

a terminal block couplable to an electronics cabinet or a mounting rail, the terminal block defining a first receptacle to receive a first circuit and a second receptacle to receive a second circuit, the terminal block comprising an integral relay couplable to the first and second circuits when the first and second circuits are received in corresponding ones of the first and second receptacles, the integral relay comprising:

a first contact and a second contact, the first contact and the second contact being externally accessible relative to the terminal block;

a first switch to be coupled between the first contact and the second contact, the first switch being movable between a first open position and a first closed position;

a second switch in series with the first switch, the second switch to be coupled between the first contact and the second contact, the second switch being movable between a second open position and a second closed position; and a test point coupled between the first switch and the second switch, the test point to enable the first switch and the second switch to be independently testable to respectively verify operability of the first and second switches.

2. The apparatus of claim 1, wherein a de-energize-to-fail circuit comprises the first switch and the second switch coupled in series.

3. The apparatus of claim 1, wherein the terminal block further comprises a first latch movable between a first position and a second position, the first position of the first latch to enable the first circuit to be secured within the first receptacle, the second position of the first latch to enable the first circuit to be removed from the first receptacle.

4. The apparatus of claim 3, wherein the terminal block further comprises a second latch movable between a first position and a second position, the first position of the second latch to enable the second circuit to be secured within the second receptacle, the second position of the second latch to enable the second circuit to be removed from the second receptacle.

5. The apparatus of claim 1, wherein the terminal block further defines a third receptacle to receive a fuse, the fuse to be coupled between the first contact and the first switch.

6. The apparatus of claim 1, wherein a baseplate is to be coupled between the terminal block and the first and second circuits.

7. A method, comprising:

actuating a first switch of an integral relay of a terminal block to a first open position to enable measurement of a first voltage between a first contact of the terminal block and a test point of the terminal block, the test point coupled between the first contact and a second contact of the terminal block, the first contact, the second contact and the test point being externally accessible relative to the terminal block;

actuating the first switch to a first closed position to enable measurement of a second voltage between the first contact and the test point;

actuating a second switch of the integral relay of the terminal block to a second open position to enable measurement of a third voltage between the second contact of the terminal block and the test point, the test point coupled between the first switch and the second switch, the first switch in series with the second switch; and actuating the second switch to a second closed position to enable measurement of a fourth voltage between the second contact and the test point, wherein the first, second, third, and fourth voltage measurements are to enable operability of the first switch and the second switch to be verified.

8. The apparatus of claim 1, wherein the first contact, the second contact, and the test point remain externally accessible relative to the terminal block for testing operability of the first switch and the second switch when the terminal block is coupled to the electronics cabinet or the mounting rail.

9. The apparatus of claim 1, wherein the terminal block further comprises:

a first coil to actuate the first switch between the first open position and the first closed position, the first coil couplable to the first circuit when the first circuit is received in the first receptacle; and a second coil to actuate the second switch between the second open position and the second closed position, the second coil couplable to the second circuit when the second circuit is received in the second receptacle.

10. The method of claim 7, further comprising coupling a first circuit and a second circuit to the integral relay of the terminal block by inserting the first and second circuits into corresponding ones of the first and second receptacles of the terminal block.

* * * * *